US005465909A

United States Patent [19]

Roth

[11] Patent Number: 5,465,909

[45] Date of Patent: Nov. 14, 1995

[54] TALKING CONTRIBUTION BOX

[76] Inventor: Rudolf Roth, 3556 Boutwell Rd., Lake Worth, Fla. 33461

[21] Appl. No.: 61,775

[22] Filed: May 13, 1993

Related U.S. Application Data

[63] Continuation of Ser. No. 827,369, Jan. 29, 1992, abandoned.

[51] Int. Cl.[6] ..... A47C 1/12; B65D 91/00

[52] U.S. Cl. ..... 232/10; 40/427; 40/455; 446/9; 369/63

[58] Field of Search ..... 232/4 R, 5, 6, 232/10; 40/427, 455; 446/8, 9; 369/31, 63, 64

[56] References Cited

U.S. PATENT DOCUMENTS

| | | | |
|---|---|---|---|
| 674,514 | 5/1901 | McNulty | 232/5 |
| 1,540,918 | 6/1925 | Aronson | 232/4 R |
| 2,304,415 | 12/1942 | Lawson | 446/9 |
| 2,336,185 | 12/1943 | Moran | 232/5 |
| 2,472,064 | 6/1949 | Kamiano | 446/9 |
| 2,496,620 | 2/1950 | Curry | 232/4 R |
| 2,663,584 | 12/1953 | Moran | 446/8 |
| 2,784,903 | 3/1957 | Brasier | 232/4 R |
| 2,911,084 | 11/1959 | Williams | 446/9 |
| 4,240,218 | 12/1980 | Kotzin | 40/455 |
| 4,815,998 | 3/1989 | McGuire | 232/4 R |

FOREIGN PATENT DOCUMENTS

| | | | |
|---|---|---|---|
| 284844 | 10/1927 | United Kingdom | 446/9 |
| 424845 | 3/1935 | United Kingdom | 232/4 R |

OTHER PUBLICATIONS

Mascon Toy Co. Catalog "#605 Ruppert Play–N–Save Talking Bank" 1966.

*Primary Examiner*—Flemming Saether
*Attorney, Agent, or Firm*—McHale & Slavin

[57] ABSTRACT

A talking contribution box for receipt of charitable contributions having a visual display of the cause for contribution. The apparatus includes a pedestal with a annular volume for housing a programmable voice driver and a transparent hollow enclosure coupled to the pedestal defining an interior for location of the visual display and further acting as a contribution receiving chamber. Placement of money through a slot provided in the enclosure operates the programmable voice or video driver for acknowledging receipt thereof.

5 Claims, 5 Drawing Sheets

TALKING CONTRIBUTION BOX

This is a continuation of application Ser. No. 07/827,369, filed on Jan. 29, 1992, now abandoned.

FIELD OF INVENTION

This invention relates to the receipt of charitable contributions and, more particularly, to a device capable of visually illustrating the objective of a request for contribution and further providing a verbal acknowledgement of contribution received.

BACKGROUND OF INVENTION

Charitable organizations survive on the generosity of the public at large. One common factor among all such organizations is the need to advertise their "cause" or purpose for requesting a contribution. If the public deems a cause viable, the public is likely to respond generously. If the public disagrees with the cause, the organization will not survive.

There are many forms of nationwide advertising used to request contributions from the public. One well know method is television in the form of a telethon. Through the use of television the public is enticed to call in their contribution. When a person does call in a contribution, an instant gratification is received in the form of a "thank you" from a telephone operator. A major disadvantage to the telethon is that a large percentage of money collected is given to advertisers, not the cause. Further, these nationwide advertising campaigns are best limited to a single cause even though an organizations may have a variety of causes they wish to assist. For instance, an organization may have a charitable drive to help disabled children during one week, foreign mission work another, homeless a third, and so forth. The public may be moved by one cause and disagree with another. If an organization advertises numerous causes, the public is likely to disagree with one of the causes and refuse to donate money to prevent endorsement of said cause.

Another form of nationwide advertising, to which this invention pertains, is the use of a locally place contribution box. A contribution box is a low cost alternative to nationwide advertising by combining a collection chamber with an advertisement. These boxes can found in restaurants, banks, grocery stores, or just about any establishment where money is exchanged.

One problem with the contribution box is, unlike television, the visual impact is limited to one dimensional advertisement. The public is inundated with such advertisements leaving little or no impact on the viewer. Further, if a still picture lacks visual impact, a pamphlet may be required to provide the donator with additional information. However, if the pamphlet lacks appeal or is written poorly, the reader may lose interest before reaching the request. Further, upon placing a contribution there is no instant gratification like that found with the telethon.

Candy for contribution is effective towards children who in turn requests the money from a parent. Upon contribution, the gratification received is the pleasurable taste of candy. A problem with this type of request is that the candy is an expense that cost the charitable organization money. Unless the donator understands the request, the contribution will be limited to the value of the candy.

Thus, the objective of solicitation is to obtain a contribution with minimal expenditure of resources thereby providing maximum profit for the cause. The use of high priced advertising or the exchange of candy for a contribution, defeats the purpose. If the public must be entertained or provided with another means to hold their attention, the request is for naught. What is needed is a low cost form of advertising that can be used nationwide or locally, has the visual impact of television, and is capable of interacting with the donator in the form of instant gratification. It is, therefore, to the effective resolution of the aforementioned problems and shortcomings that the present invention is directed.

SUMMARY OF INVENTION

Generally, the invention relates to an apparatus or device capable of enticing contributions by use of a visual display which further provides a verbal acknowledgement upon receipt of contribution.

The instant invention device employs a transparent hollow enclosure wherein a figurine or the like visual display is placed on a pedestal in the interior of the enclosure. For instance, a replica of crippled child immediately informs the public that a contribution is for crippled children. The display provides a visual impact that is not possible with still picture advertisement or description in pamphlets. The enclosure includes an opening for placement of contributions into the enclosure. Further unique to this invention is that upon placement of a contribution through the opening, a mechanism is actuated that provides a short message in response to the contribution. The message can a complete narrative of the cause, a message, song, note, or simply a "thank you" for the contribution. This message provides the response that the donator appreciates from a telethon without the expense of having a live person to accept the contribution.

The instant invention is battery powered and includes a self contained alarm system which is activated if the device is moved. The enclosure is transparent allowing past contributions to be viewed. A lockable door provides a means for accessing money donated or exchange of the figurine. Beneath the enclosure is an opaque pedestal to disguise the position of the programmable voice actuator.

Accordingly, it is the primary object of the present invention to provide an inexpensive form of localized advertising that appeals to the sense of charity in the public by use of a visual display such as a replica to depict the cause.

Another object of the present invention is to provide an apparatus that acknowledges receipt of a contribution.

Other objects and advantages of this invention will become apparent from the following description taken in conjunction with the accompanying drawings wherein set forth, by way of illustration and example, certain embodiments of this invention. The drawings constitute a part of this specification and include exemplary embodiments of the present invention and illustrate various objects and features thereof.

BRIEF DESCRIPTION OF THE DRAWINGS

The invention may be better understood by reference to the drawings in which.

DETAILED DESCRIPTION OF THE INVENTION

Figure 1:
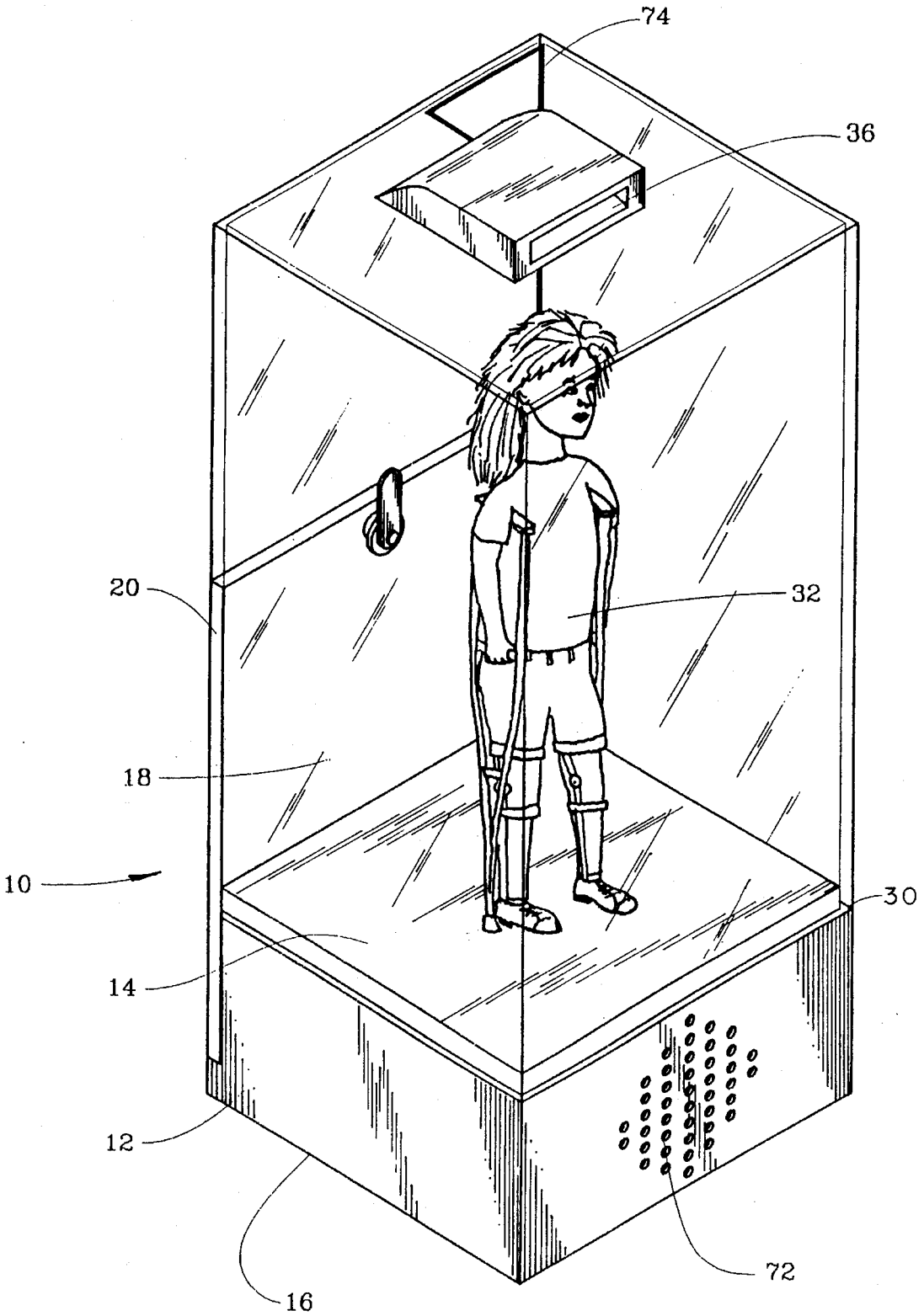
FIG. 1 is a perspective view of the instant invention.
Figure 2:
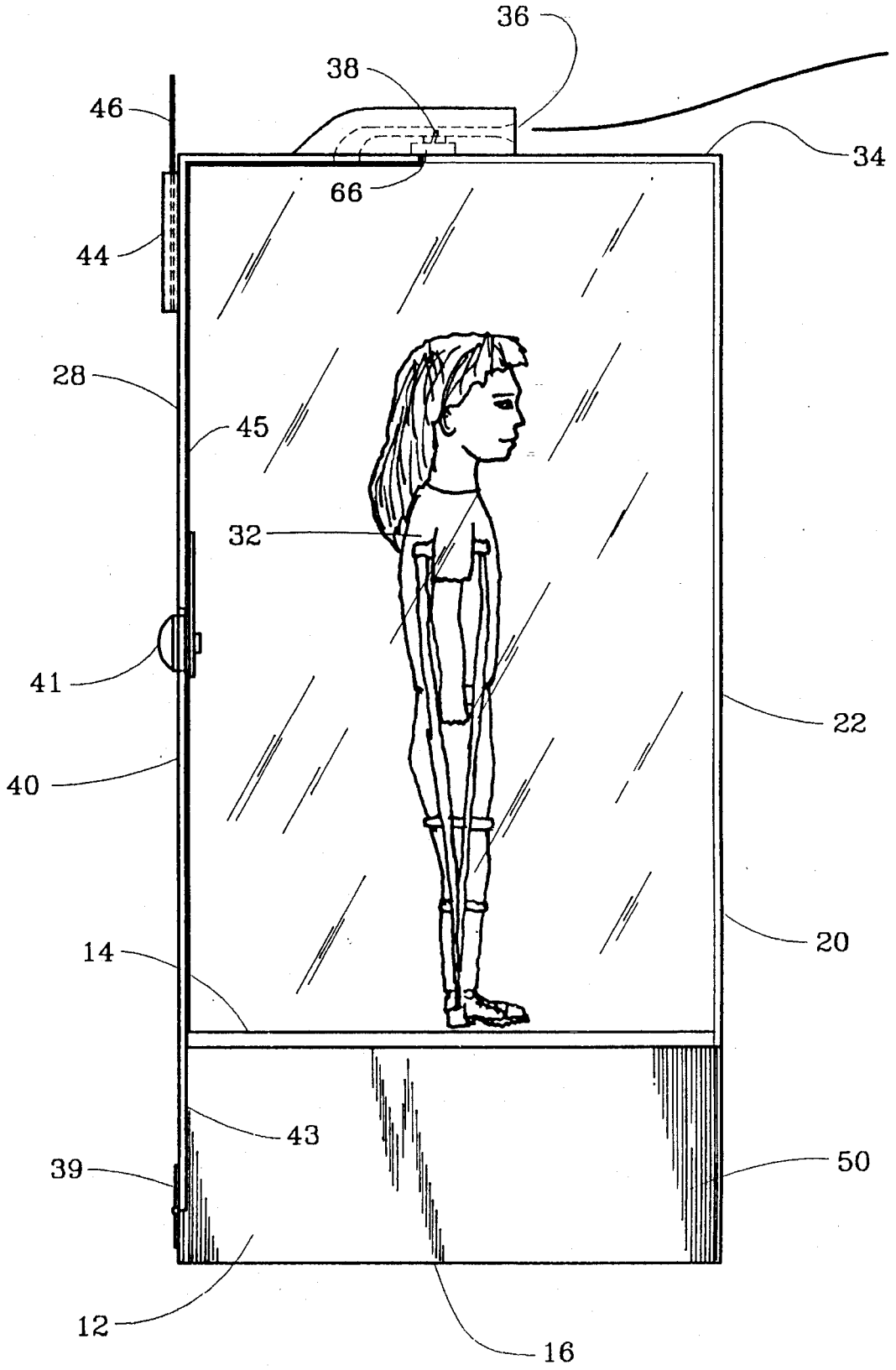
FIG. 2 is a side elevation view of the instant invention illustrating the operation of the voice actuating mechanism.
Figure 3:
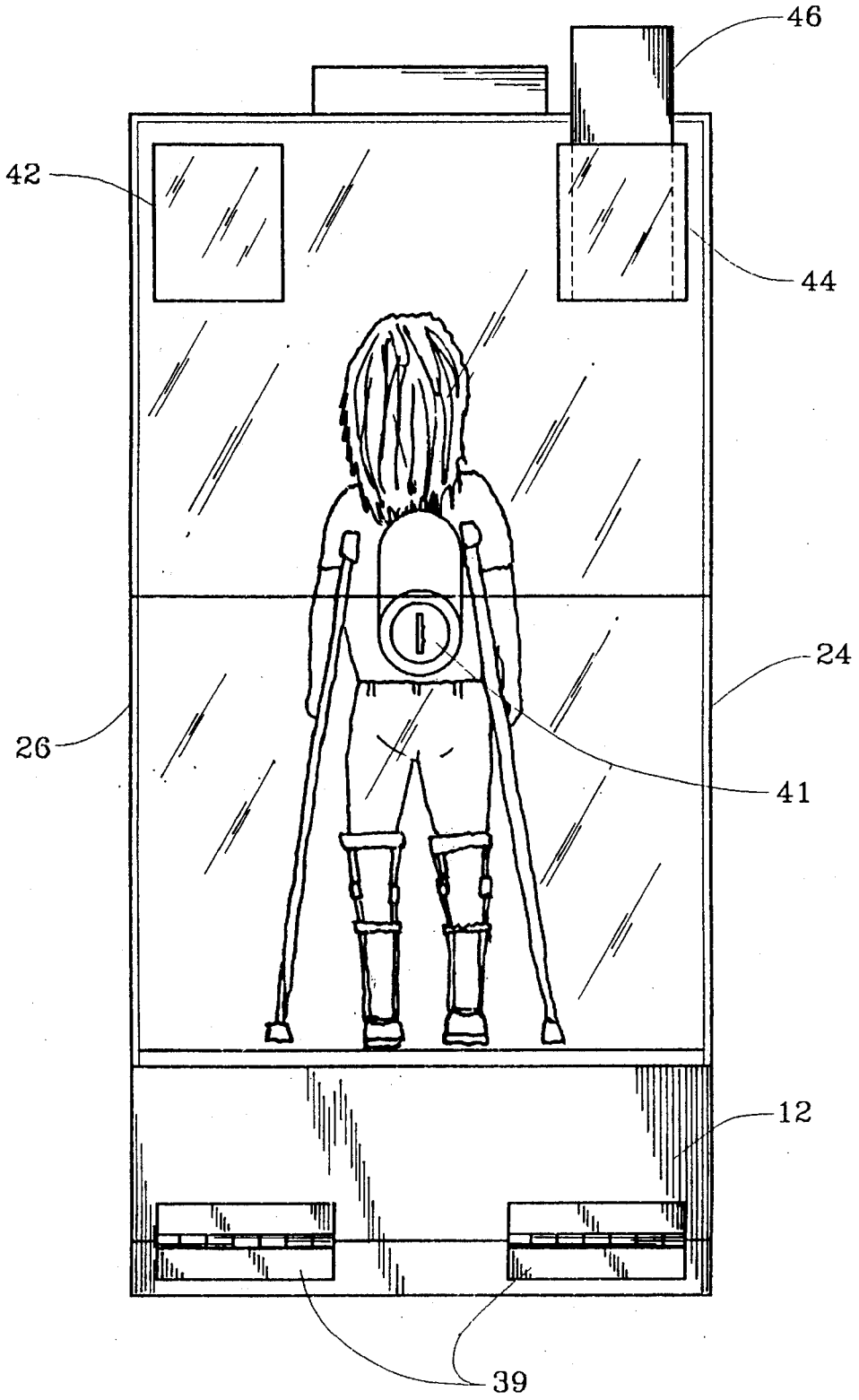
FIG. 3 is a back elevation view depicting the access door and pamphlet holders.

As required, detailed embodiments of the present invention are disclosed herein, however, it is to be understood that the disclosed embodiments are merely exemplary of the invention which may be embodied in various forms. Therefore, specific functional and structural details disclosed herein are not to be interpreted as limiting, but merely as a basis for the claims and as a representative basis for teaching one skilled in the art to variously employ the present invention in virtually any appropriately detailed structure, Referring in general to FIGS. 1–4, the contribution box 10 is shown employing an opaque hollow pedestal 12 having a generally flat upper surface 14 and lower or bottom surface 16. Operatively associated with the pedestal 12 is an interior chamber shown as enclosure 18 and defined by front wall 22, side walls 24 and 26, and back wall 28. The walls are constructed of transparent or translucent material such as plastic or acrylic and are fastened together at each edge 20 in such a manner so as not to impede visual insight yet effectively encapsulate the enclosure 18 further placing it contiguous to the pedestal 12 along juncture 30 having cover 34 to complete the enclosure. The interior chamber of the enclosure 18 serves as a location for placement of a visual display 32 and as a contribution receiving chamber. A typical visual display or figurine consists of a doll fixated to replicate the cause of the request for contribution. The use of the figurine or like display provides an instant indication to the potential donator why the contribution is sought. The cover 34 is releasably attached by use of fasteners 35 disposed along the outer permiter of the enclosure. Removale of the cover provides ease of access to the interior of the enclosure for removal of the figurine 32 or donations.

A slot 36 disposed in the cover 34 for insertion of contributions into the interior of the enclosure 18. Operatively associated with the slot 36 is a lever 38 disposed beneath the slot 36 for actuating of trip switch 66 used in conjunction with a voice actuating mechanism. Operation of the trip switch 66 is described in detail later in this specification. It should be noted that location of the slot 36 is not critical to its operation as the function of the slot 36 is to allow insertion of contributions into the interior of the enclosure 18. Thus, placement of the slot 36 and associated hardware for voice activation can be placed on any wall and not deemed a limiting factor to this specification.

Figure 4:
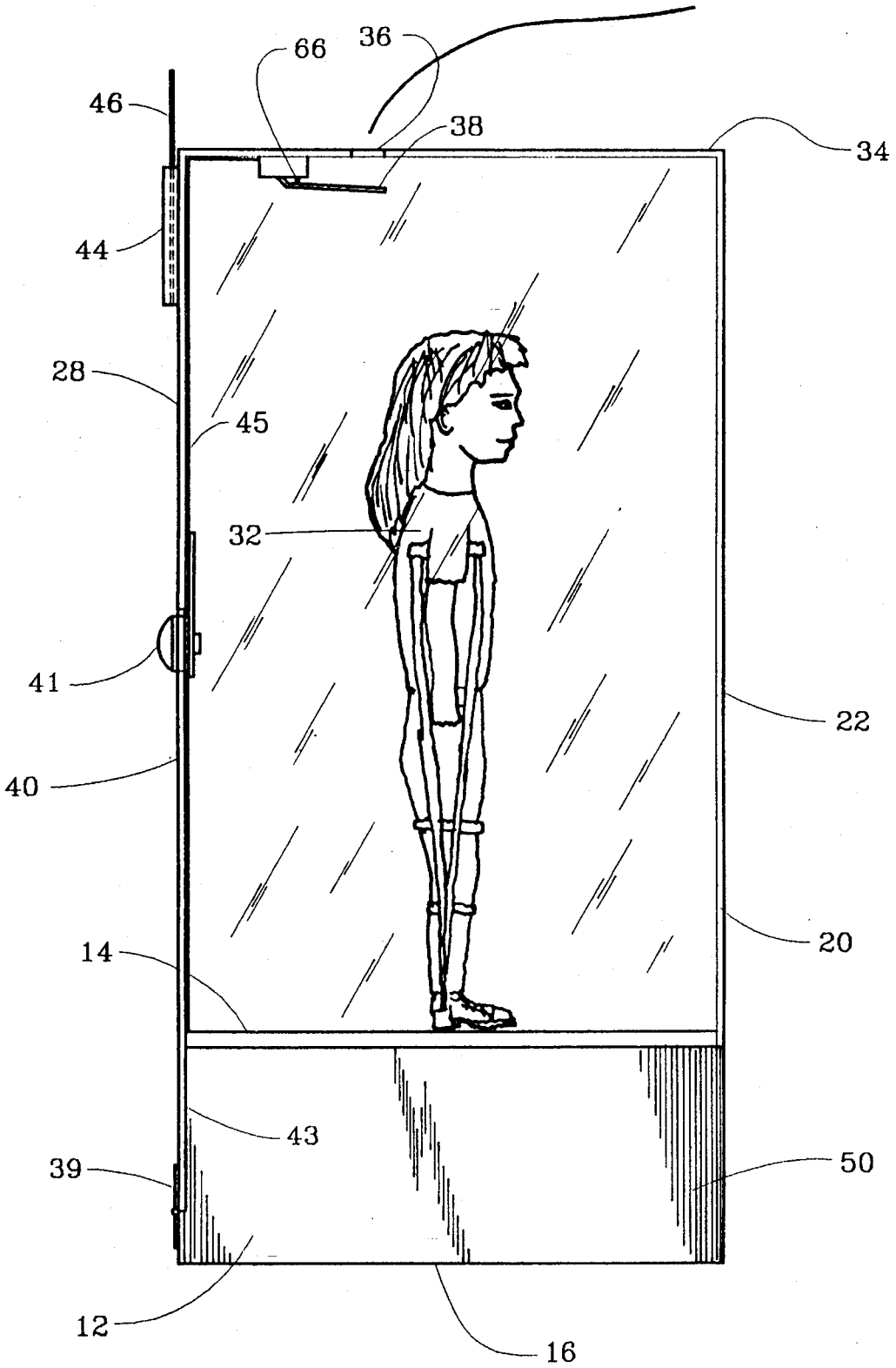
FIG. 4 is a side elevation view of the instant invention illustrating an alternative embodiment for triggering the voice actuating mechanism.

FIG. 4 depicts cover 34 having a simplified slot 36 disposed therein whereby insertion of a contribution through slot 36 pushes against lever 38 for actuating of trip switch 66 used in conjunction with a voice actuating mechanism. Hingedly 39 connected access door 40 is made lockable 41 to the back wall 28 of the device. The access door can be sized to allow access to the upper surface 14 of the pedestal 12 for removal of contributions or exchange of the figurine 32 in a like manner or as an alternative to removable cover 34. Primarily the access door 40 provides access to the voice driver mechanism located in the pedestal 12. The enclosure 18 includes pockets 42 and 44 attached thereto for placement of pamphlets 46. The electrical cabling 74 is placed inconspicuously along the edge of the enclosure 18 connecting the voice actuator 66 with the voice drive 50.

Figure 5:
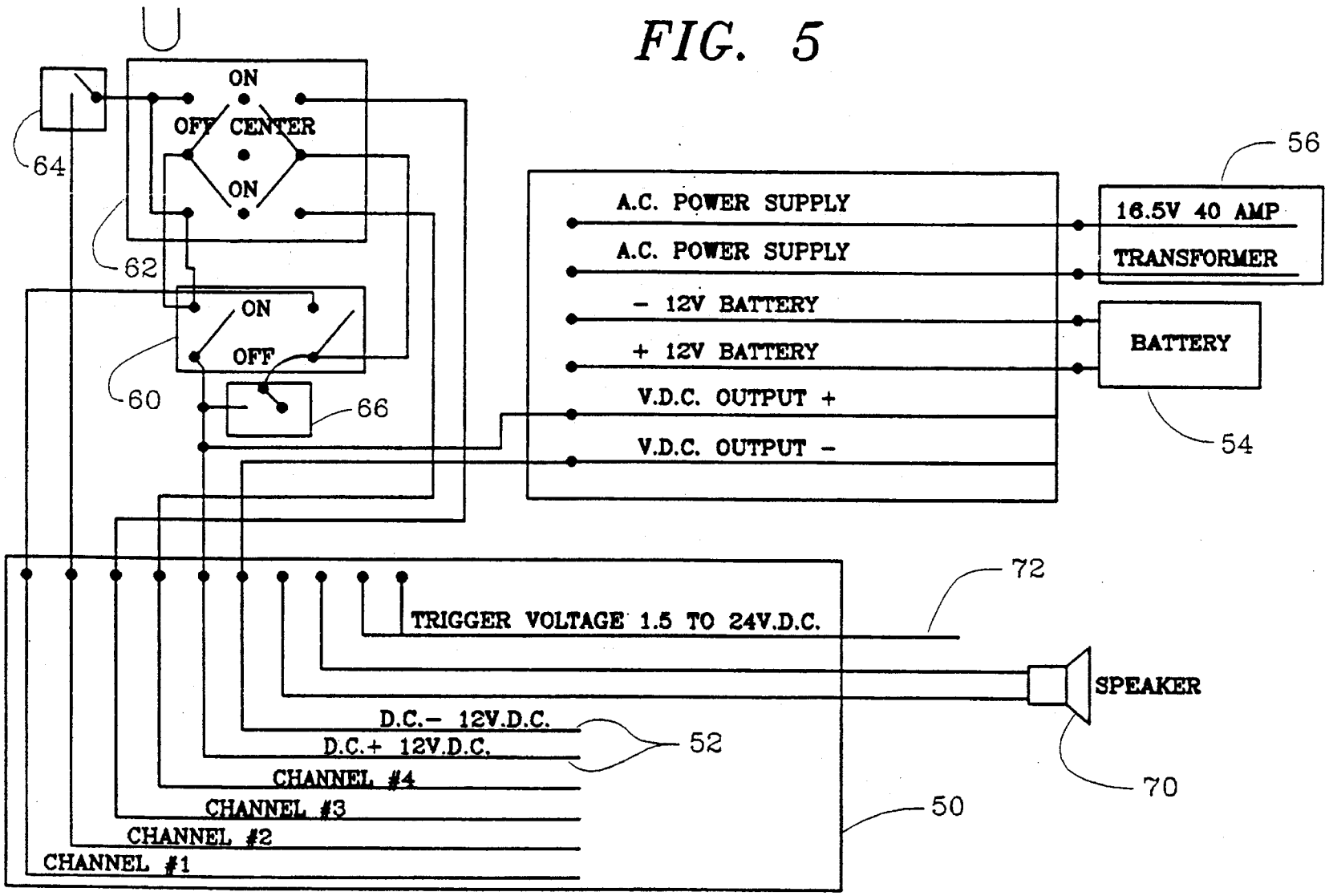
FIG. 5 is an electrical schematic of the device.

Now referring to FIG. 5 wherein a conventional four channel programmable voice driver 50 is employed. The voice driver 50 is powered by a direct current 5 V to 19 V source 52 which in turn can be a battery 54 or alternating current volt source 56 by use of transformer 58. Slide switch 60 and center switch 62 are used to control individual voice channels #1, #2, #3, and #4. Each voice channel may be preprogrammed with a response for contribution or other response, including theft prevention. For instance, voice channel #2 is shown set up as an alarm system wherein placement of switch 60 placed in the "on" position, and switch #62 is off, couples the power source to mercury switch 64. The mercury switch 64 is made operational by movement of the apparatus wherein mercury switch 64 is electrical connected the circuit completed to channel #2. Similarly, switch 62 provides alarm protection when its switch is placed in an "on" position, and switch #60 is off.

Operation of the apparatus for acknowledgement of a contribution is performed by selecting a preprogrammed response by selection of a pre-programmed channel. For instance, placement of switch 60 selectably directs power to channel #1 when in the "on" position and switch # 62 is in the "off" position, wherein placement of a contribution through slot 64 causes trip switch 66 to activate voice channel #1. Placement of switch 62 in a first "on" position, allows activation of voice channel #3, switch #60 in the "off" position, when a contribution is placed through the slot 36 thereby activating trip switch 66. Accordingly, when switch 62 in placed in a second "on" position, voice channel #4, switch #60 is in the "off" position, is activated upon placement of a contribution through slot 36. Speaker 72 amplifies the prerecorded voice channels, the speaker 72 disposed with the interior of the pedestal 12 behind grille 72. Alternatives to the voice driver can be used, such as a conventional tape recorder, without defeating the object of this invention.

It is to be understood that while we have illustrated and described certain forms of my invention, it is not to be limited to the specific forms or arrangement of parts herein described and shown. It will be apparent to those skilled in the art that various changes may be made without departing from the scope of the invention and the invention is not to be considered limited to what is shown in the drawings and described in the specification.

What I claim as new and desire to secure by Letters Patent of the United States is:

1. An improved portable talking contribution box for soliciting monetary contributions for a specific predetermined cause having an opaque, substantially square pedestal having a top wall and a bottom wall separated by four equal sized sidewalls defining an interior chamber therebetween, said top wall disposed horizontal to said bottom wall, a transparent enclosure having a substantially square cover bounded along its outer edges by four equally sized sidewalls extending upwardly from said pedestal sidewalls defining an interior chamber for placement over said top wall of said pedestal, said cover having a slot located therein for insertion of currency and coins from above, said interior chamber receiving and retaining said currency and coins, one of said side walls of said enclosure including a hingedly connected access door having a means for locking, said contribution box comprising:

an exchangeable visual display embodying a specific contributable cause disposed within said interior chamber of said enclosure supported by said top wall of said pedestal;

a playing means having at least two independently programmable channels, one channel having a programmed message to assimilate said visual display and said contribution cause for acknowledging receipt of a contribution logistically located in said interior chamber of said pedestal and actuated by insertion of currency in said slot; and a means for detecting enclosure movement operatively associated with said playing means for activation of a second channel having a prerecorded warning message;

whereby placement of the visual display within the interior of said enclosure visually illustrates said cause of the request for contribution and wherein insertion of money through said slot is acknowledged by use of said programmed message assimilating the visual display and said contribution cause.

2. The contribution box according to claim 1, wherein said cover is releasably coupled to said sidewalls of said enclosure.

3. The contribution box according to claim 1, wherein said enclosure includes pockets attached thereto for placement of pamphlets, said pamphlets describing the cause of the request depicted by the visual display.

4. The contribution box according to claim 1, wherein a levered electronic trip switch is operatively associated with said slot, said trip switch is triggered upon insertion of money through said slot.

5. The contribution box according to claim 1, wherein said visual display is a doll fixated to replicate the cause of the request for contribution.

* * * * *